US006499954B1

(12) United States Patent
Adonakis

(10) Patent No.: US 6,499,954 B1
(45) Date of Patent: Dec. 31, 2002

(54) CENTRIFUGAL IMPELLER AND HOUSING

(75) Inventor: Nikolaos A. Adonakis, West Bloomfield, MI (US)

(73) Assignee: Textron Automotive Company Inc., Troy, MI (US)

( * ) Notice: Subject to any disclaimer, the term of this patent is extended or adjusted under 35 U.S.C. 154(b) by 77 days.

(21) Appl. No.: 09/643,160

(22) Filed: Aug. 21, 2000

(51) Int. Cl.[7] ..... F04D 29/30
(52) U.S. Cl. ..... 416/185; 416/223 B; 416/DIG. 2
(58) Field of Search ..... 416/183, 185, 416/186 R, 223 B, 238, DIG. 2

(56) References Cited

U.S. PATENT DOCUMENTS

| | | | | | |
|---|---|---|---|---|---|
| 45,755 | A | * | 1/1865 | Sandford | 416/186 R |
| 513,057 | A | | 1/1894 | Poole | |
| 2,114,050 | A | | 4/1938 | Findley | |
| 2,330,938 | A | | 10/1943 | Williams | |
| 2,341,871 | A | | 2/1944 | Karrer | |
| 3,246,834 | A | | 4/1966 | Swenson | |
| 3,301,472 | A | | 1/1967 | Dixon et al. | |
| 3,407,995 | A | | 10/1968 | Kinsworthy | |
| 3,950,112 | A | | 4/1976 | Crump et al. | |
| 4,213,742 | A | | 7/1980 | Henshaw | |
| 4,448,573 | A | | 5/1984 | Franz | |
| 4,666,373 | A | * | 5/1987 | Sugiura | 416/185 |
| 4,919,592 | A | | 4/1990 | Sears et al. | |
| 5,518,449 | A | | 5/1996 | Danieu | |
| 6,093,096 | A | | 7/2000 | Miyata et al. | |

FOREIGN PATENT DOCUMENTS

| | | | | |
|---|---|---|---|---|
| GB | 2057567 | | 4/1981 | |
| JP | 55-125396 A | * | 9/1980 | 416/186 R |
| JP | 60-145497 | | 7/1985 | |
| WO | WO 90/08262 | | 7/1990 | |
| WO | WO 90/09524 | | 8/1990 | |

* cited by examiner

*Primary Examiner*—Christopher Verdier
(74) *Attorney, Agent, or Firm*—Grossman, Tucker, Perreault & Pfleger, PLLC

(57) ABSTRACT

A centrifugal impeller blade is disclosed that comprises a leading edge, a trailing edge, a front surface and a rear surface. At least one of the front surface or a rear surface is at least partially defined by a radius extending from the leading edge to the trailing edge. A centrifugal impeller housing is also disclosed having one or more outlets.

6 Claims, 12 Drawing Sheets

CENTRIFUGAL IMPELLER AND HOUSING

FIELD OF THE INVENTION

This invention relates to centrifugal impellers and, more particularly, a unique blade design and housing. Particular utility of the present invention is found in automotive heating, ventilation, and air conditioning (HVAC) systems.

BACKGROUND OF THE INVENTION

Centrifugal impellers are often used in automotive heating, ventilation, and air conditioning (HVAC) systems to provide air flow into the passenger compartment. Typically, a cylindrical impeller located within a housing is driven by an electric motor and rotates in a predetermined direction. The impeller blades draw air in axially (i.e. along the impeller's axis of rotation) and discharge air radially away from the axis of rotation. Generally the housing surrounding the impeller is scroll shaped and directs incoming air along a flow path from an air inlet to an air outlet.

Prior art impellers have been designed to rotate in a single direction, such as clockwise. Consequently, in order to ensure that the motor driving the impeller always rotates the impeller in the same desired direction, the system designer must choose an appropriate electric motor. Typical electric motors available to the designer include both brush and brushless motors.

Impeller blades may be forward or rearward curved, depending on the angle of the blade tip relative to a tangent to the blade at the tip. This angle is called the blade exit angle. If the blade exit angle is greater than 90°, the impeller is said to have forwardly curved blades; if the blade exit angle is less than 90°, the impeller is said to have rearwardly curved blades. In general, rearwardly curved blades are more nearly flat than forwardly curved blades, which are often distinctly concave or scoop shaped.

The contour of prior art impeller blades has traditionally been designed using a combination of complex curved sections. Impeller blade designers often use French curves to draw each complex curved section and to connect the complex curved sections together. In this manner, impeller blade design has been often more art than engineering. Also, the more complex the curves and the more of them, the more expensive the resulting blade is to manufacture and balance. These complex curves and the lack of understanding of the principals of air flow often result in undesirable audible noise during impeller operation that represents a continuing source of frustration for impeller designers.

There is a need for an impeller that does not suffer from the deficiencies of the prior art. There is a need for an impeller with a simply formed blade contour which is easier to balance, easier to manufacture and has a smaller packaging size. There is also a need for an impeller that can be rotated in either the forward or backward (e.g. clockwise or counterclockwise) direction which has the same achievable mass flow rate such that it may be used in combination with a brushless motor without added control circuitry.

Impellers typically reside in impeller housings. The overwhelming majority of centrifugal impeller housings comprise a single scroll. In other words, a volute or spiral shaped air flow channel extending for upwards of 270 degrees around the perimeter of the impeller. The purpose of the volute is to decrease the speed of the air exiting the impeller blades at the perimeter of the impeller and increase its static pressure. In this manner, air contained in the volute flows out from an area of high pressure within the volute to an area of lower pressure outside the volute without any added work.

In order to decrease the speed of the air exiting the impeller blades at the perimeter of the impeller and increase its static pressure, the volute increases in cross-sectional area as it extends radially around the impeller. The increase in cross-sectional area decreases the speed of the air exiting the perimeter of the impeller. At the outlet of the volute, there may be located a flow inhibitor (e.g. damper) which controls air flow out of the impeller housing which acts to further control the static pressure built by the volute of the housing.

In the automotive industry, it is typically necessary for the volute to extend for 270 degrees around the perimeter of the impeller. A typical impeller measures 5 inches in diameter by 4 inches in height. The air flow generated by the impeller generally must act upon an evaporator with a size of 13 inches by 11 inches. The evaporator is typically located adjacent the outlet of the volute. Consequently, the volute must generally increase from approximately 4 inches in a height and minimal width at its inception to a size of 13 inches by 11 inches at its outlet. In doing so, it has been found that the rate of increasing cross-sectional area is inversely related to static pressure. In other words, the lower the rate of increasing cross-sectional area the greater the static pressure. Thus, automotive HVAC designers are generally predisposed to extending the volute around the impeller substantially for its entire perimeter in order to reduce the rate of increasing cross-sectional area as much as possible in efforts to gain static pressure.

While impeller housings with a single volute extending substantially around the perimeter of an impeller are common place, they present several problems. First, the increase in cross-sectional area of the volute as it extends around the impeller is typically obtained by progressively increasing the outer radial dimension of the volute outward away from the impeller axis as it extends around the impeller. Consequently, the packaging space (i.e. size) of the impeller housing substantially increases. As a solution to this problem, an impeller housing has also been designed in which the increase in cross-sectional area of the volute occurs by progressively increasing the axial dimension of the volute as it extends around the impeller. For another solution, an impeller housing has been designed in which the increase in cross-sectional area of the volute occurs by progressively increasing the axial dimension of the volute as it extends around the impeller in combination with progressively decreasing the inner radial dimension of the volute towards the impeller axis as it extends around the impeller.

The example above of an impeller housing design in which the increase in cross-sectional area of the volute occurs by progressively increasing the axial dimension of the volute as it extends around the impeller in combination with progressively decreasing the inner radial dimension of the volute towards the impeller axis as it extends around the impeller may be found in U.S. Pat. No. 4,919,592. While the '592 Patent may offer an impeller housing providing a constant outer radial dimension, the static pressure which may be generated within the impeller housing is believed less than which may be created from more conventional impeller housings (i.e. where the increase in cross-sectional area of the volute is obtained by progressively increasing the outer radial dimension of the volute outward away from the impeller axis as it extends around the impeller). As shown in FIGS. 4–5 of the '592 Patent, the collection chamber 42 enlarges radially inward below the impeller 38. Also as shown in FIG. 3 of the '592 Patent, outlet 46 is located beneath the compressor. As a result, a portion of the impeller 38 must pass directly above the outlet 46. Consequently, due to the overlying relationship, any air flow generated from the impeller 38 at this point does not enter the collection chamber 42, but rather is lost through the outlet 46. Accordingly, this loss of air flow reduces the static pressure which may be generated within the collection chamber as compared a more conventional impeller housing where no such loss is incurred.

While solutions have been proposed to solve the packaging space problem associated with impeller housings having a single volute extending substantially around the perimeter of an impeller, none of these solutions address the structural imbalance of such a design. By its nature, the flow symmetry created with an impeller housing having a single volute and outlet is lopsided. Thus, loads placed on one side of the design are significantly greater than loads placed on the other side of the design. Consequently, with operation of such a housing it is apt to vibrate and create noise. This is a significant problem to overcome by automotive HVAC designers. They must now design isolator structures to prevent vibration and noise inherent with the use of impeller housings having a single volute and outlet from being heard and/or transgressing into other parts of the automobile. This adds time and expense to the manufacture of the automobile as a whole.

Also the solutions have been proposed to solve the packaging space problem associated with impeller housings having a single volute extending substantially around the perimeter of an impeller do not address the aerodynamic losses associated with such a design. This is due to, for example, boundary layer effects and diffusion of air out of the housing.

There is therefore a need for an impeller housing that does not suffer from the deficiencies of the prior art. There is a need for an improved impeller housing that offers better air flow symmetry, reduced noise, vibration and harshness (NVH), reduced need for isolation structure, reduced aerodynamic losses, and faster diffusion all resulting in higher efficiency and better energy management.

SUMMARY OF THE INVENTION

According to a first aspect of the invention, a centrifugal impeller is provided comprising a plurality of impeller blades radially spaced about a center axis, each impeller blade comprising a leading edge, a trailing edge, a front surface and a rear surface, and at least one of the front surface or the rear surface of an impeller blade is defined by single radii extending from the impeller blade leading edge to the impeller blade trailing edge.

According to another aspect of the invention, the centrifugal impeller blade further comprises an outside diameter radius, and the radii extending from the impeller blade leading edge to the impeller blade trailing edge are greater than 9/20 of the impeller blade outside diameter radius.

According to another aspect of the invention, the centrifugal impeller blade further comprises an outside diameter radius, and the radii extending from the impeller blade leading edge to the impeller blade trailing edge are in the range between and including ½ to ⅔ of the impeller blade outside diameter radius.

According to another aspect of the invention, the centrifugal impeller blade further comprises an inside diameter radius and an outside diameter radius, and the impeller blade inside diameter radius is in the range between and including ¼ to ½ of the impeller blade outside diameter radius.

According to another aspect of the invention, the centrifugal impeller blade further comprises an inside diameter radius and an outside diameter radius, and the impeller blade inside diameter radius is equal to ⅓ of the impeller blade outside diameter radius.

According to another aspect of the invention, the centrifugal impeller blade further comprises an outside diameter radius, and the outside diameter radius is in the range between and including 2.0 to 3.5 inches.

According to another aspect of the invention, adjacent impeller blades are radially spaced by a separation angle, and the impeller blade leading edge and the impeller blade trailing edge are radially spaced by three times the separation angle.

According to another aspect of the invention, the plurality of impeller blades comprises a prime number.

According to another aspect of the invention, the radii extending from the impeller blade leading edge to the impeller blade trailing edge comprise a single radius.

According to another aspect of the invention, a centrifugal impeller assembly for a motor vehicle is provided comprising a centrifugal impeller having a center axis and a housing comprising a first air outlet and second air outlet. The first air outlet is in fluid communication with a first spiral shaped air flow channel which displaces the first air outlet away from the impeller. The second air outlet is in fluid communication with a second spiral shaped air flow channel which displaces the second air outlet away from the impeller.

According to another aspect of the invention, the first spiral shaped air flow channel and the second spiral shaped air flow channel of the centrifugal impeller assembly may be symmetrical or asymmetrical.

According to another aspect of the invention, a first mass flow rate of air exits from the first spiral shaped air flow channel and a second mass flow rate of air exits from the second spiral shaped air flow channel of the centrifugal impeller assembly. The first mass flow rate of air exiting from the first spiral shaped air flow channel and the second mass flow rate of air exiting from the second spiral shaped flow channel may be equal or unequal.

According to another aspect of the invention, at least one of the first mass flow rate of air exiting from the first spiral shaped air flow channel and the second mass flow rate of air exiting from the second spiral shaped flow channel may be controlled by a damper.

According to another aspect of the invention, the first mass flow rate of air exiting from the first spiral shaped air flow channel and the second mass flow rate of air exiting from the second spiral shaped flow channel may join outside the housing.

According to another aspect of the invention, the first mass flow rate of air exiting from the first spiral shaped air flow channel is in fluid communication with an evaporator and the second mass flow rate of air exiting from the second spiral shaped flow channel is in fluid communication with a heater core.

According to another aspect of the invention, at least one of the first spiral shaped air flow channel and the second spiral shaped air flow channel increase in cross-sectional area radially about the center axis of the impeller.

According to another aspect of the invention, at least one of the first spiral shaped air flow channel and the second spiral shaped air flow channel increase in cross-sectional area radially outward from the center axis of the impeller.

According to another aspect of the invention, at least one of the first spiral shaped air flow channel and the second spiral shaped air flow channel increase in cross-sectional area radially inward towards the center axis of the impeller.

According to another aspect of the invention, at least one of the first spiral shaped air flow channel and the second spiral shaped air flow channel increase in cross-sectional area axially about the center axis of the impeller.

According to another aspect of the invention, the centrifugal impeller housing further comprises at least one air inlet.

According to another aspect of the invention, the impeller receives air from at least two air sources.

According to another aspect of the invention, the impeller receives air from inside the vehicle and outside the vehicle.

According to another aspect of the invention, the first air outlet and the second air outlet may be equally or unequally circumferentially spaced in the housing around the center axis of the impeller.

BRIEF DESCRIPTION OF THE DRAWINGS

To better understand and appreciate the invention, refer to the following detailed description in connection with the accompanying drawings.

DETAILED DESCRIPTION OF THE DRAWINGS

It will be appreciated by those skilled in the art that, although the following detailed description will proceed with reference being made to preferred embodiments, the present invention is not intended to be limited to these preferred embodiments.

Figure 1:
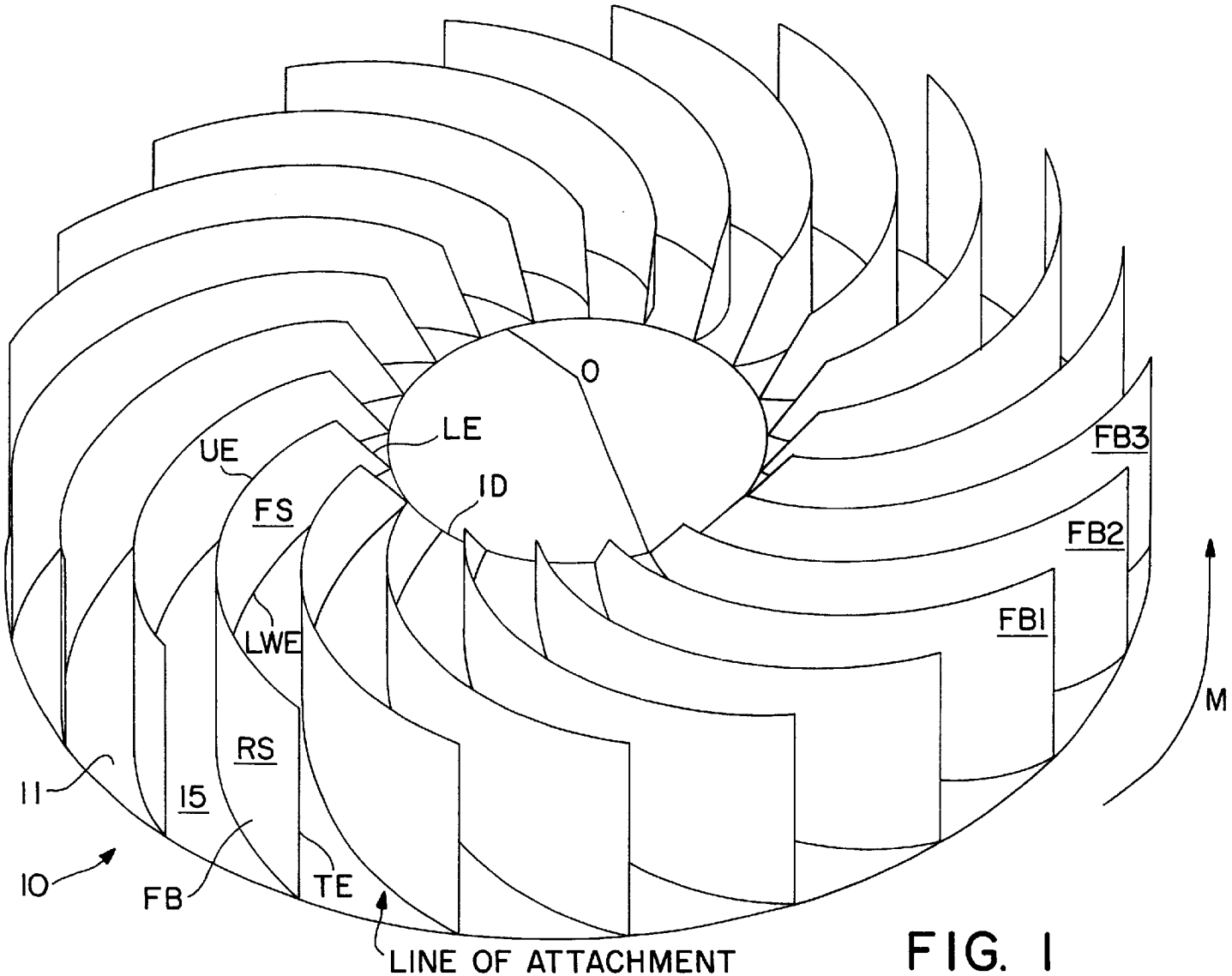
FIG. 1 is a perspective view of an impeller in accordance with the present invention.
Figure 3:
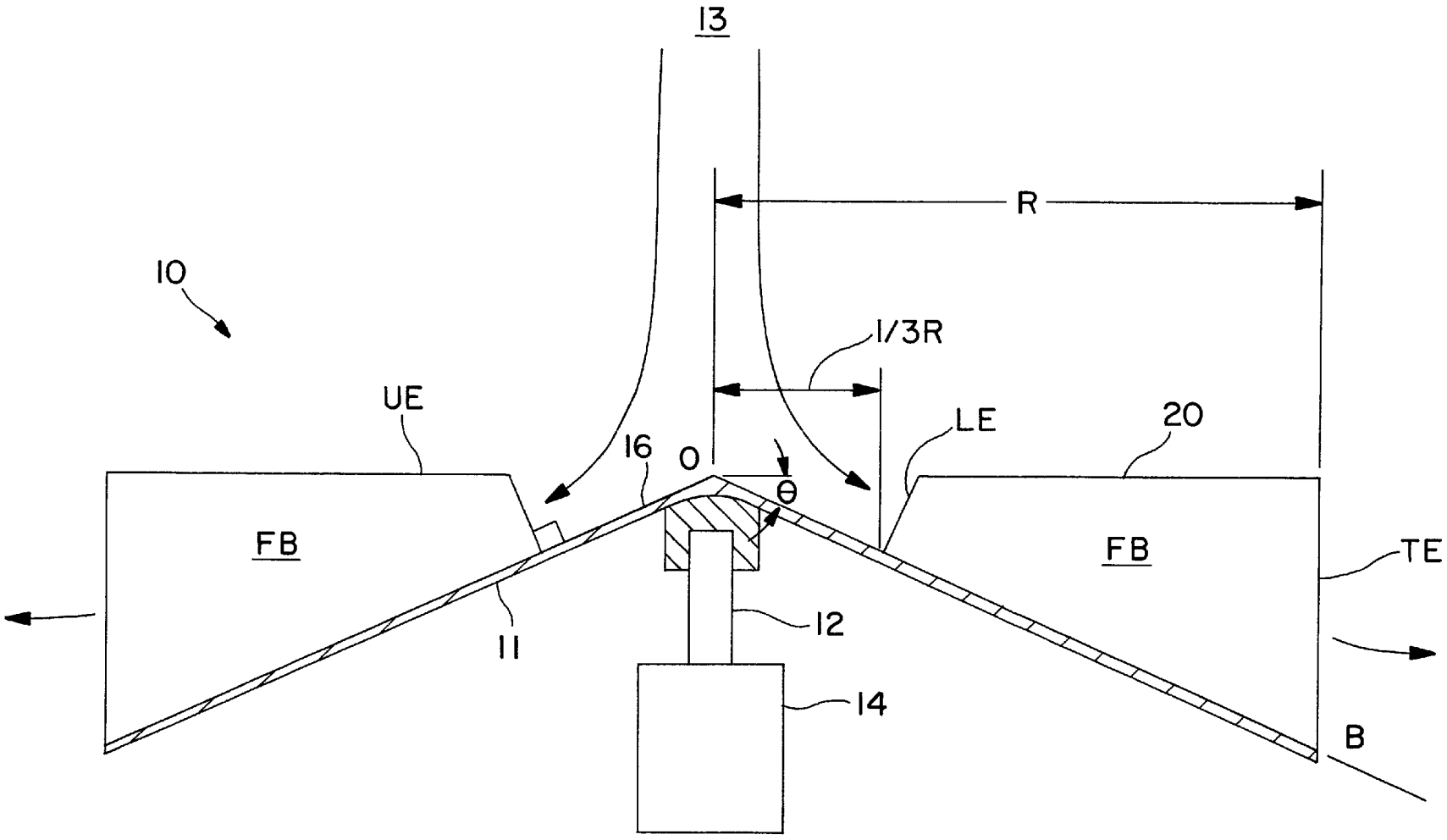
FIG. 3 is a sectional view of an impeller taken between the impeller blades in accordance with the present invention.

Referring now to the drawings, FIG. 1 shows a perspective view of an impeller 10. The forward direction of impeller 10 is preferably counterclockwise as indicated by arrow M. Impeller 10 comprises a plurality of impeller blades FB. As best shown in FIG. 3, impeller blades FB are preferably secured to and more preferably integrally formed with a hub plate 11 to form the impeller 10. As shown, the hub plate 11 is preferably conical relative to the center axis O and, more preferably, creates a downwardly sloped hub plate angle theta θ of 30 degrees relative to the center axis O. However, the hub plate angle theta θ may range typically between 10 degrees and 45 degrees.

As shown in FIG. 1, the impeller blades FB are forwardly curved and comprise a front surface FS, a rear surface RS, a leading edge LE, a trailing edge TE, an upper edge UE, and a lower edge LWE. The impeller blades FB meets the hub plate 11 along the lower edge LWE of the impeller blades FB along a single line of attachment. As best shown in FIG. 3, the trailing edges TE of the impeller blades FB are preferably parallel with the center axis O of the impeller 10. The leading edge LE of the impeller blade FB and the hub plate 11 of the impeller 10 meet to preferably form a right angle.

The impeller 10 can be manufactured from materials including, but not limited to, plastics and metal. Preferably, the impeller 10 is manufactured from plastic and, more preferably a thermoplastic (e.g. polyamide, polyurethane, polycarbonate, acrylonitrile-butadiene-styrene, polycarbonate-acrylonitrile-butadiene-styrene, polyethylene, polypropylene, acetal, polyester, polystryene, polyphenylene oxide) using an injection molding process. Alternatively, when the impeller 10 is manufactured from metal, it is preferably manufactured from cast aluminum or magnesium in order to reduce the moment of inertia and enhance performance.

Figure 2:
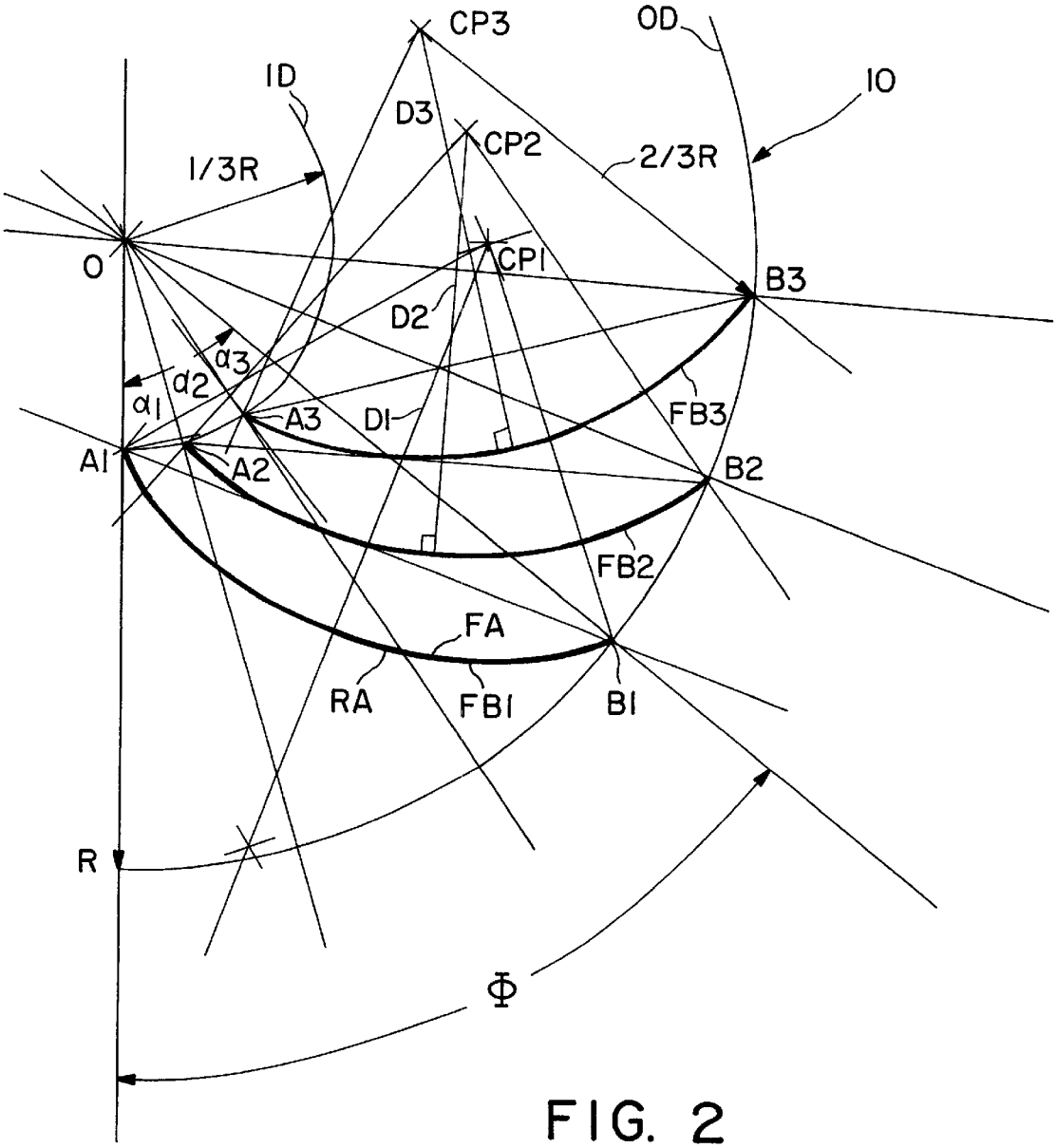
FIG. 2 is a partial top view of an impeller in accordance with the present invention.

FIG. 2 shows a partial top view of the impeller 10 of FIG. 1 and, more particularly, exemplary impeller blades FB1–FB3. Impeller blades FB1–FB3, as well as all the impeller blades FB, are radially distributed and equally spaced about a center axis O. The contour of the impeller blades FB is such that one or more "simple" arcs FA preferably define the front surface FS of impeller blades FB from the leading edge LE to the trailing edge TE. In other words, for example, the arc FA defining the upper edge UE of the impeller blades FB from the leading edge LE to the trailing edge TE comprises a partial circle formed from a single radius drawn from a single center point.

Exemplary impeller blades FB1–FB3 extend from a inside diameter ID starting at the leading edge LE of the impeller blade FB to an outside diameter OD ending at the trailing edge TE of the impeller blade FB. More preferably, the front surface FS of the impeller blade FB from the upper edge UE to the lower edge LWE is defined by one or more simple arcs FA comprising a single radius from the leading edge LE to the trailing edge TE. Also preferably, the front surface FS of the impeller blade FB is perpendicular to a plane defined by the upper edge UE of the impeller blades FB. Also preferably, the impeller blades FB have a uniform thickness and the rear surface RS of the impeller blades FB is also made from one or more simple arcs RA having the same center point as the arc FA.

The first step in forming an impeller 10 according to the present invention is to determine the outside diameter OD and the inside diameter ID of the impeller 10. The outside diameter OD and the inside ID of the impeller 10 are determined by the amount of air that needs to be circulated and other factors that are well known in the art of impeller design. For automotive heating, ventilation, and air conditioning (HVAC) systems, typically the outside diameter OD of the impeller 10 is in the range of 4 inches to 7 inches (radius 2 inches to 3.5 inches). However, it is recognized that the outside diameter OD may be smaller than 4 inches or larger than 7 inches depending on the particular application.

As shown in FIG. 2, the outside diameter OD of the impeller 10 has a radius R. The inside diameter ID formed by the leading edge of the impeller blades FB1–FB3 where it meets the hub plate 11 preferably has a radius ⅓ R (i.e. 33% of the value of R), but may be as large as ⅗ R (60% of R) for automotive HVAC applications. However, it is recognized that the inside diameter ID may be smaller then ⅓ R (33%R) or larger than ⅗ R (60%PR) depending on the particular application, and any single percentage increment therebetween. For example, in other embodiments the inside diameter ID may be in the range of ¼ R to ½ R.

Preferably, both the front surface FS and rear surface RS of impeller blades FB comprise simple arcs FA and RA, respectively, of the same contour. More preferably, the front surface FS of the impeller blade FB from the upper edge UE to the lower edge LWE is defined by one simple arc comprising a single radius from the leading edge LE to the trailing edge TE. More preferably, the radius of the arc FA, forming the contour of the front surface FS of impeller blades FB is ⅔ R and the radius of the arc RA, forming the contour of the rear surface RS of impeller blades FB is larger than ⅔ R by the thickness of the impeller blade FB.

In FIG. 2, a point on the leading edge LE of impeller blade FB1 at the intersection with the inside diameter ID is marked A1, and a point on the trailing edge TE of impeller blade FB1 at the intersection with the outside diameter OD is marked B1. Correspondingly, a point on the leading edge LE of impeller blade FB2 at the intersection with the inside diameter ID is marked A2, and a point on the trailing edge TE of the impeller blade FB2 at the intersection with the outside diameter OD is marked B2, and so forth for the remainder of the impeller blades FB.

Continuing with FIG. 2, impeller blades FB are equally spaced by a separation angle alpha α, which directly relates to the number of impeller blades FB. Angle alpha α is preferably in the range of 11 degrees to 18 degrees, which corresponds to a number of impeller blades FB of 32 to 21, respectively. Within the range of 21 to 32 blades, the number of impeller blades FB preferably comprises an prime number to avoid resonance phenomenon and contribute to noise reduction. When a prime number of blades is used, angle alpha α results in a mixed number (i.e. a whole number with a fractional component). The fractional component may continue for infinity or terminate. To reduce noise, fractional components which continue for infinity are preferred over those which terminate. Thereafter, fractional components which continue for infinity may be further characterized as repeating or random. To further reduce noise, random fractional components which continue for infinity and are preferred to those which may be characterized as being repeating. If, however, a repeating fractional component is all that is afforded, the fractional component with a longer repeating sequence is preferred over the fractional component with the shorter repeating sequence.

In automotive HVAC systems having a fan diameter between 4 and 7 inches, the preferred number of blades is 21. When 21 equally spaced impeller blades are divided into a 360 degree circle an angle alpha a of $17.\overline{142587}$ degrees results in which the repeating decimal (i.e. $.\overline{142587142587142587}$) continues for infinity.

With respect to the center axis O, point A1 on the impeller blade FB1 lies on the line $\overline{OA1}$ and point B1 lies on the line $\overline{OB1}$. Relative to one another, line $\overline{OA1}$ and line $\overline{OB1}$ are separated by an angle phi Φ, which is preferably equal to three times angle alpha α (i.e. Φ=3α). Consequently, the location of points A1 and B1 at the intersections of the inside diameter ID and the outside diameter OD are known relative to one another.

Alternatively, the angle phi Φ could be equal to 2α or 4α . However, it is not preferred as it deviates from the preferred "⅓" design symmetry. In other words, as previously indicated, the inside diameter ID of the impeller 10 is preferably equal to ⅓ R. Consequently, the resulting distance separating the inside diameter ID from the outside diameter is ⅔ R. Also as previously indicated, the preferred radius of the arc FA forming the contour of the front surface FS of impeller blades FB is ⅔ R. In maintaining the "⅓" design symmetry, ⅓Φ is preferably equal to a or stated another way, preferably Φ=3α.

Continuing with FIG. 2, once the points A1 and B1 have been established, the points are then used as center points in the formation of intersecting arcs. The radius of the arcs is equal to the desired radius of either front arc FA or rear arc RA, whichever the case may be. As indicated above, the radius of the arcs FA of impeller blades FB is preferably ⅔ R. When intersecting arcs using the center points A1 and B1 and a radius of ⅔ R are formed, the arcs will intersect at two points that lie on the dichotomous D1 of line $\overline{A1B1}$. From these two points, the point CP1 is selected which, for an impeller 10 which rotates counterclockwise in the forward direction and clockwise in the rearward direction, is the point on the dichotomous D1 of line $\overline{A1B1}$ displaced counterclockwise relative to both points A1 and B1. Alternatively, in the case of an impeller 10 that rotates clockwise in the forward direction and counterclockwise in the rearward direction, CP1 is the point on the dichotomous D1 displaced clockwise relative to both points A1 and B1. In other words, CP1 is the point displaced in the same direction as the forward direction of rotation relative to both points A1 and B1.

Once point CP1 is determined, it is next used as the center point to form an arc of the same radius (i.e. ⅔ R) passing through both points A1 and B1. The above process is then repeated around the impeller 10 for each impeller blade FB.

In other embodiments, arcs FA and RA may be comprised of a radius greater than ⅔ R. For example, arcs FA and RA may be comprised of a radius equal to R. With regards to smaller radii, arcs FA and RA may be comprised of any radius smaller than ⅔ R and equal to at least the length of line $\overline{A1B1}$ divided by 2 (i.e. $\overline{A1B1}/2$), in which case the point CP1 will lie on the line $\overline{A1B1}$. However, preferably, the arcs FA and RA reside fully within the boundaries defined by angle phi Φ and the outside diameter OD of the impeller 10. In such a case, the smallest radii arcs FA and RA may comprise is about 9/20 R.

More preferably, arcs FA and RA comprise a radius between and including ½ R to ⅔ R. Arcs below ½ R are less preferred because they represent blades with less curvature therefore contain less volume of air. Also depending on the operating speed (for this design) blades below ½ R will cause flow separation which causes structural vibrations, and high audible noise. Arcs above ⅔ R are also less preferred because they represent blades with larger than needed curvature therefore the flow does separate in a pattern that generates cavitation phenomena and voriticity. These phenomena disturb the flow in an inefficient way and generate NVH in a structural and audible mode.

As indicated above, the front surface FS of the impeller blade FB from the upper edge UE to the lower edge LWE may be defined by more than one simple arc from the leading edge LE to the trailing edge TE. In other words, the simple arcs FA forming the front surface FS of the impeller blades FB from the leading edge LE to the trailing edge TE do not necessarily have to be of all the same radius, but may comprise different radii from the upper edge UE to the lower edge LWE.

In other embodiments the simple arcs FA forming the front surface FS of the impeller blades FB from the leading edge LE to the trailing edge may vary between (e.g. adjacent) impeller blades FB. For example, by combining impeller blades having a first radius with impeller blades having a second radius, the flow pattern can be broken at high RPM and NVH can be reduced. For example, impeller blades with a radius ½ R can be combined with adjacent impeller blades having a radius ⅔ R.

Turning to FIG. 3, the impeller 10 is shown in a sectional view taken between exemplary impeller blades FB. During operation, air 13 enters the impeller 10 axially from the top of the impeller 10 then passes between the leading edges LE of the impeller blades FB and into a flow path 15 (see FIG. 1). Flow path 15 is defined on its sides by the contour of the front surface FS and rear surface RS of two adjacent impeller blades FB, and preferably on the bottom by the hub plate 11. Air 13 within flow path 15 then exits between the trailing edges TE of the impeller blades FB. A motor 14 with an output drive shaft 12 rotates to cause the impeller 10 to rotate about the center axis O.

As previously indicated, the impeller blades FB shown in FIG. 1 are forwardly curved relative to a counterclockwise direction of rotation. However, the impeller blades FB may also be considered rearwardly curved for a clockwise direction of rotation. Regardless of the direction of rotation, the impeller 10 of the present invention may produce the same mass flow rate m in either direction of rotation.

Figure 4A:
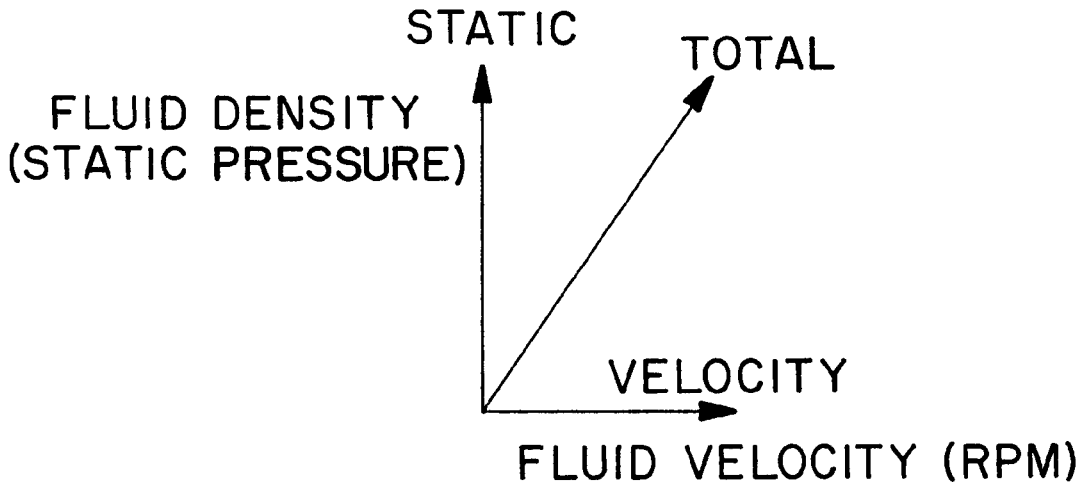
FIG. 4A is a plot of static pressure vs. velocity for an impeller with forwardly curved blades relative to the direction of rotation.
Figure 4B:
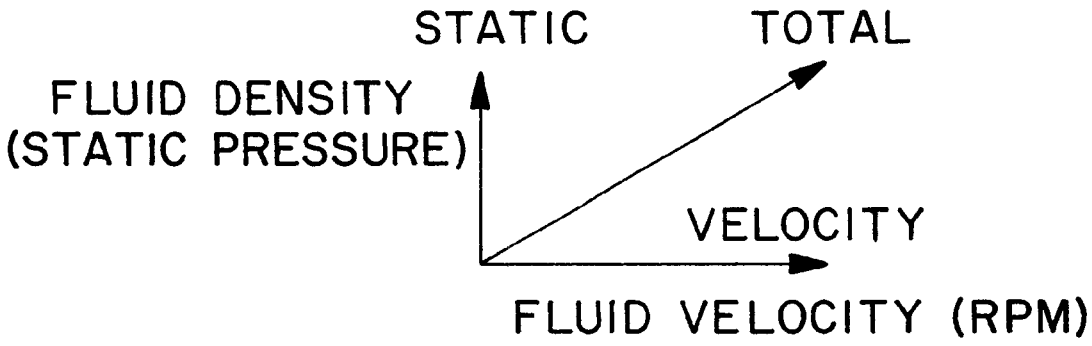
FIG. 4B is a plot of static pressure vs. velocity for an impeller with rearwardly curved blades relative to the direction of rotation.

Mass flow rate m may be calculated as the product of fluid density, fluid velocity, and flow path cross-sectional area as follows:

$$m=(p)\times(u)\times(S)$$

where p=fluid density; u=fluid velocity; and S=cross-sectional area. Assuming S=constant, the mass flow rate m becomes a function of fluid density p and fluid velocity u, which may be illustrated using vector analysis. Vector analyses with respect to mass flow rate m for forwardly and rearwardly curved impeller blades FB are shown in FIGS. 4A and 4B, respectively. FIGS. 4A and 4B, illustrate increasing fluid density p plotted against increasing fluid velocity u. More particularly, increasing fluid density p may be achieved by increasing static pressure which is identified along the Y axis of the plot. Conversely, increasing fluid velocity u may be achieved by increasing the rotation speed (i.e. revolutions-per-minute) of the impeller 10 which identified along the X-axis of the plot.

As can be seen from a comparison of FIGS. 4A and 4B, the length of the resultant vector of increasing density p and increasing the velocity u (i.e. "TOTAL") is about equal for both the forwardly and rearwardly curved impeller blades. However, in achieving this result, the magnitude of the input variables, namely density p and velocity u is reversed. In other words, with respect to velocity, in FIG. 4A (i.e. forwardly curved impeller blades) the density for a given velocity is higher than the density illustrated in FIG. 4B (i.e. rearwardly curved impeller blades). However, with respect to density, in FIG. 4A (i.e. forwardly curved impeller blades) the air velocity for a given density is lower than the air velocity illustrated in FIG. 4B (i.e. rearwardly curved impeller blades).

In a practical sense, FIGS. 4A and 4B illustrate that, for a given rotation speed, an impeller 10 which utilizes impeller blades FB which are forwardly curved will achieve a higher mass flow rate m than an impeller 10 which utilizes impeller blades FB which are rearwardly curved. Also, stated another way, for a given mass flow rate m, an impeller 10 which utilizes impeller blades FB which are forwardly curved may be operated at a lower rotation speed than an impeller 10 which utilizes impeller blades FB which are rearwardly curved to achieve the same result.

Due to the increased performance of the impeller 10 disclosed above, the impeller has certain features which distinguish it from conventional centrifugal impellers found in current motor vehicle HVAC architectures. With attention directed again at FIG. 2, the resulting distance separating the inside diameter ID from the outside diameter is ⅔ R. This also corresponds to a distance from the LE to the TE of the impeller blade. Accordingly, in the context of the present invention, it has been found that the value of ⅔ R is preferably between 1.3–2.3". The impeller blades of the present invention has been found to operate efficiently with a height (H) of only about 2.0 inches. This allows for the identification of an aspect ratio, A.R.=H/[⅔ R]. Accordingly, the A.R. of the present invention preferably falls between 0.814 1.5. However, in broad context, the A.R. falls between 0.5–3.5, and varies therein by 0.1 increments.

The impeller 10 of the present invention has been found to satisfactorily operate with a height of only about two inches. The decrease in height is critical for two reasons. First, centrifugal impellers which operate in a motor vehicle HVAC applications are often mounted such that the center axis O is horizontal. Consequently, the impellers often exhibit problems with cantilever effects. In other words, the upper edge UE of the impellers are distal from the center axis mounting locations. Thus, the upper edge UE of the impellers is prone to vibrate resulting in undesirable noise. Shorting the impeller from its conventional height of about four inches to about two inches, the impeller 10 of the present invention reduces negative cantilever effects by decreasing the length of the cantilever. Second, impellers of conventional height (i.e. 4 inches) have an upper support ring which extends circumferentially around the impeller along the upper edge UE. The upper support ring is often added to reduce noise caused by cantilever effects discussed above and add stability to the impeller blades. However, it is often difficult and expensive to incorporate in plastic molded impellers due to tooling considerations. Conversely, the impeller 10 of the present invention has been found suitable to operate in motor vehicle HVAC applications without any support ring.

The impeller 10 of the present invention thus provides a simply formed blade contour which is easier to balance, easier to manufacture and has a smaller packaging size. The impeller 10 may also be rotated in either the forward or backward (e.g. clockwise or counterclockwise) direction and have the same achievable mass flow rate such that it may be used in combination with a brushless motor without added control circuitry.

Figure 5:
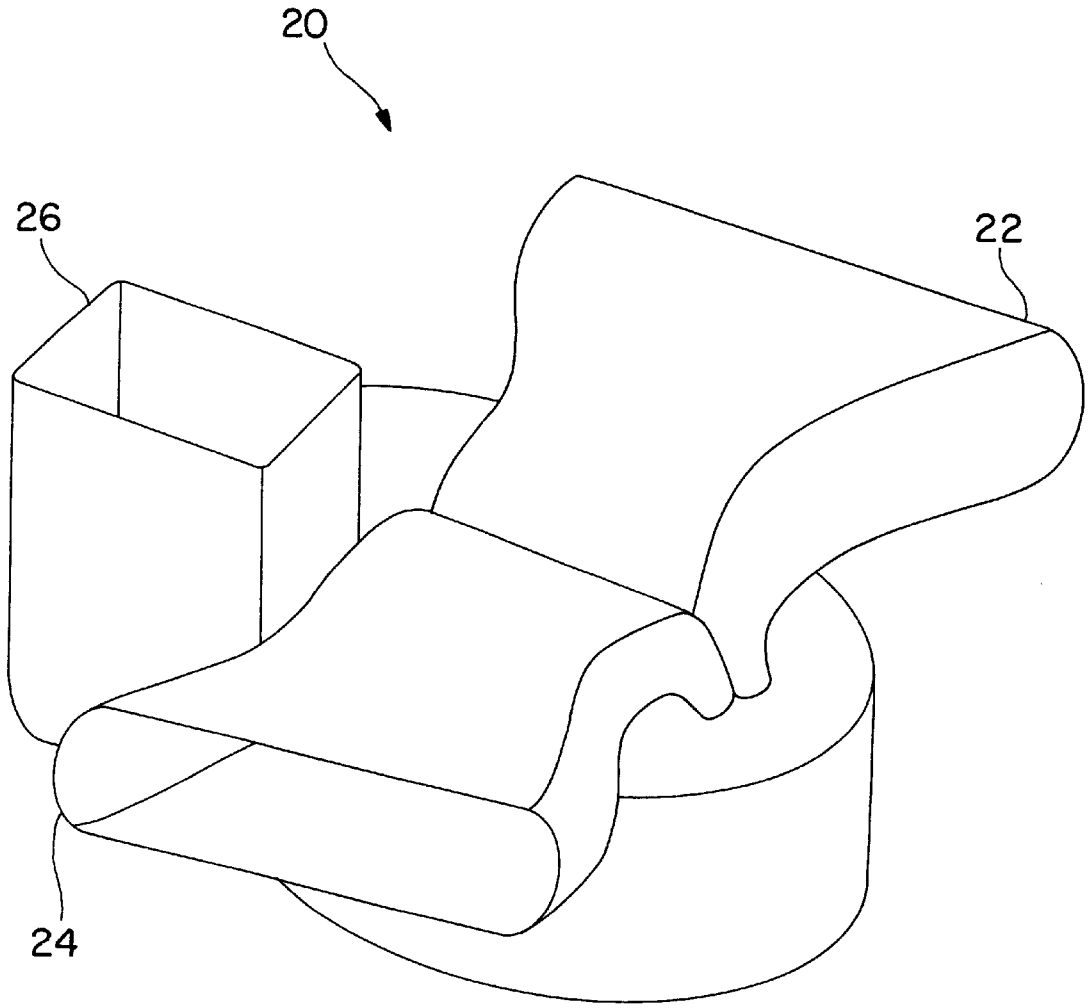
FIG. 5 is a perspective view of a first embodiment of a housing having a single air outlet.

FIG. 5 shows a perspective of the first embodiment of the housing 20 which contains impeller 10. However, it is recognized that use of the housing 20 is not constrained by the particulars of the design of impeller 10. As shown the housing 20 has two air inlets 22, 24 and a single air outlet 26. Air inlets 22, 24 may be used to receive air of different temperatures and /or percent moisture content from two different sources. Air inlets 22, 24 may also be used to receive fresh air (i.e. from outside the vehicle) or recirculated air (i.e. from inside the vehicle). However, housing 20 may also have a single air inlet which receives air from a single source.

Figure 5A:
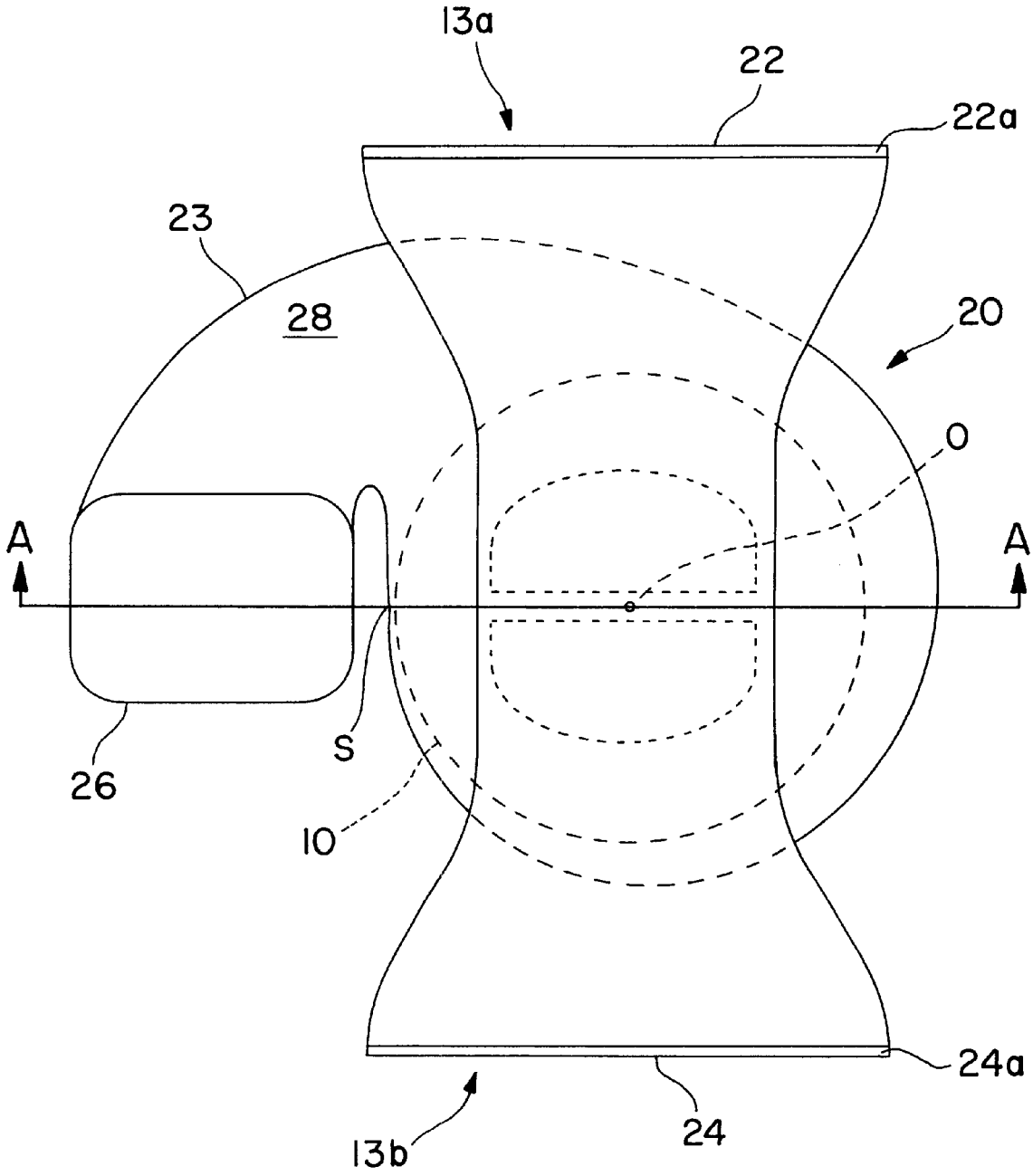
FIG. 5A is a top view of the impeller and housing of FIG. 5.

As best shown in FIG. 5A, first source air 13*a* and second source air 13*b* preferably pass through air filters 22*a* and 24*a* respectively within air inlets 22 and 24 respectively. The first source air 13*a* and the second source air 13*b* preferably mix together just prior to entering the top of the impeller 10. The ratio of first source air 13*a* to second source air 13*b* may be controlled by at least one damper (not shown).

The housing 20 surrounds the impeller 10 and together with the impeller 10 defines a flow channel 28, preferably in the form of a spiral or volute extending radially between a starting point S and the air outlet 26. In terms of operation, air enters the impeller axially along the center axis O as the impeller 10 is rotated, for example, in a counterclockwise direction and preferably at a constant speed. This causes the air to move between the impeller blades FB in a counterclockwise direction until it ultimately exits the impeller 10 at the trailing edge TE of the impeller blades FB and into flow channel 28.

In order to compress and densify the air, that is, increase its static pressure; its velocity must be decreased after exiting the impeller 10. This is preferably accomplished by progressively increasing the cross-sectional area of the flow channel 28 as it proceeds in its counterclockwise direction. Preferably, the cross-sectional area of the flow channel 28 is increased by progressively increasing the outer radial (i.e. horizontal) dimension of the flow channel 28 outward relative to the center axis O, that is, the outer wall 23 of the housing 20 as it extends around the impeller 10. As shown in FIG. 5A, the flow channel 28 starts with a narrow width at a point S and progressively increases in width, and thus the cross-sectional area of the flow channel 28, as it spirals towards the air outlet 26.

Figure 5B:
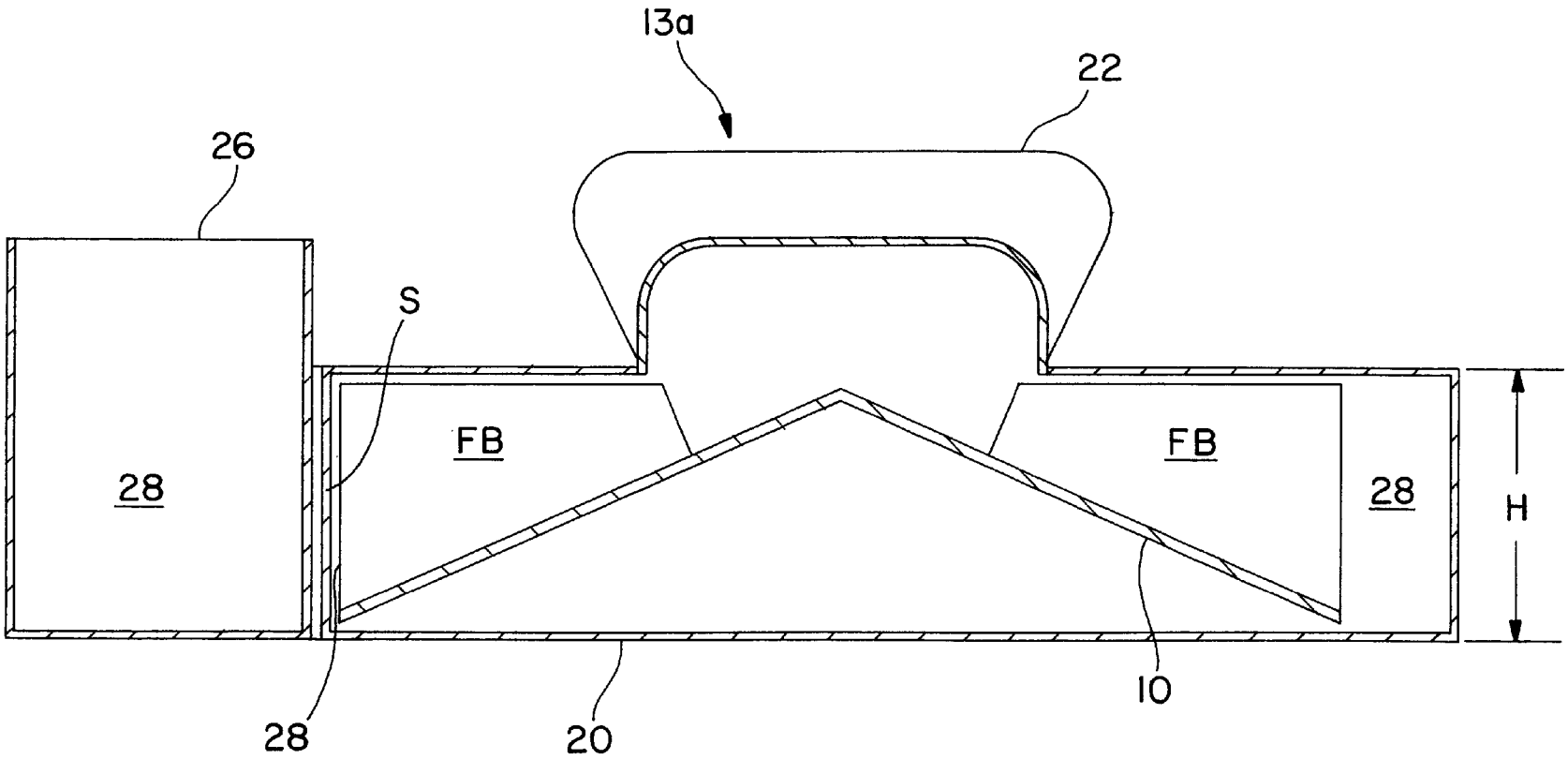
FIG. 5B is a section view of the impeller and housing of FIG. 5A along line A—A of FIG. 5A.

As shown in FIG. 5B, the axial (i.e. vertical) dimension of the flow channel 28 may remain at a constant height H from the start point S to the outlet 26. However, in an alternative embodiment as shown in FIG. 5C, the height H of the flow channel 28 may progressively increase from height H at the start point S to a height H' as it extends towards the outlet 26.

Progressively increasing the axial dimension of the flow channel 28 as it extends around the impeller 10 in combination with progressively increasing the outer radial dimension of the flow channel 28 is desirable in order to further increase the cross-sectional area of the flow channel 28. Correspondingly, this will further decrease the velocity of air exiting the impeller over an equivalent radial distance, or possibly obtain the same decrease in velocity (as compared to increasing the outer radial dimension solely) in a shorter radial distance.

Figure 5C:
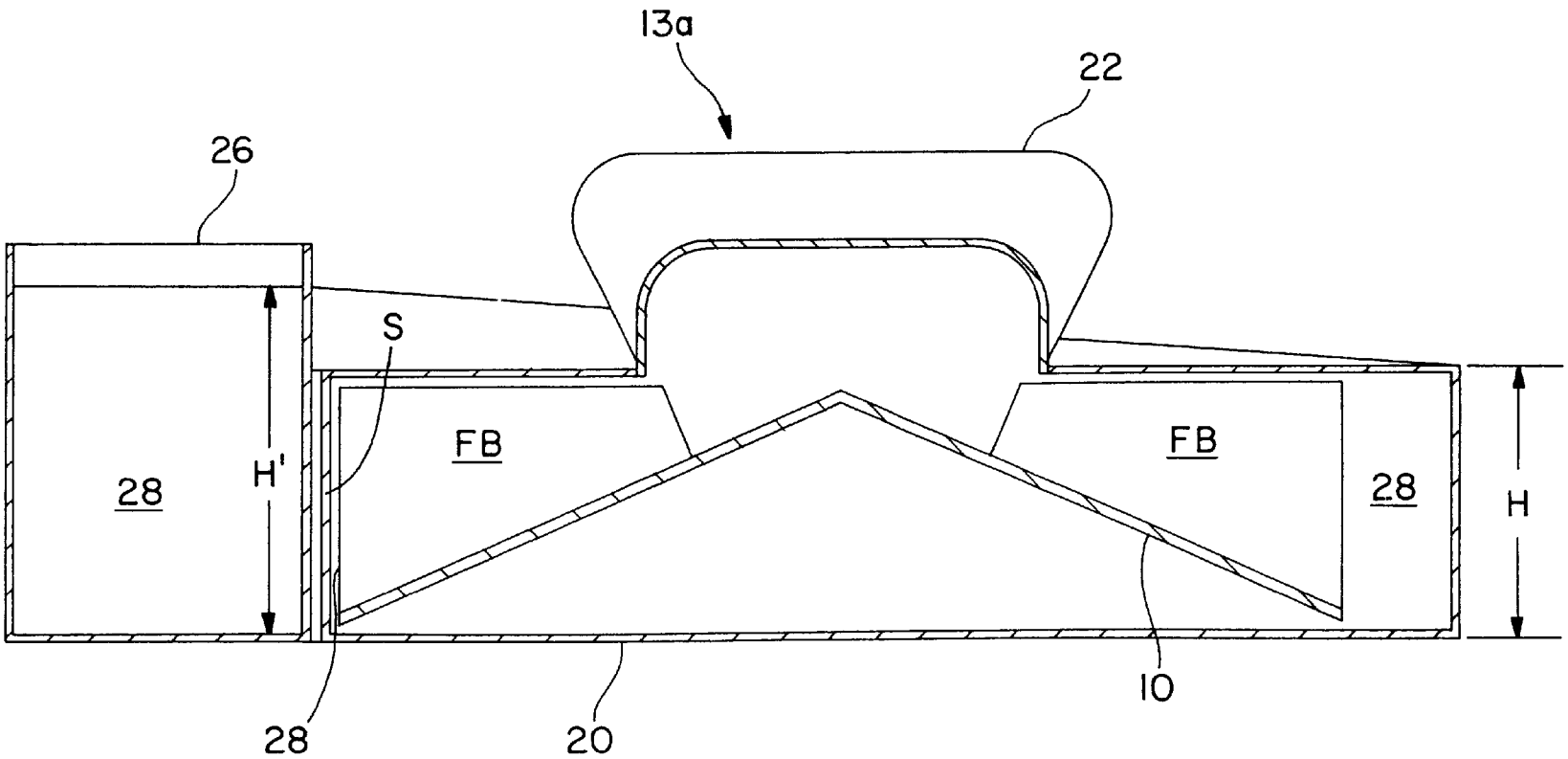
FIG. 5C is a section view of a second embodiment of a housing having a single air outlet and taken along line A—A of FIG. 5A.

As shown in FIG. 5C, the height H of the flow channel 28 progressively increases axially (i.e. vertically) upward from height H at the start point S to a height H' at outlet 26. In other words, axially upward from the upper edge UE of the impeller blades FB. However, in another embodiment (not shown), height H of the flow channel 28 may progressively increase axially (i.e. vertically) downward from height H at the start point S to a height H" at outlet 26. In other words, axially downward from the hub plate 11 of the impeller 10.

In another embodiment (not shown,), progressively increasing the axial dimension of the flow channel 28 as it extends around the impeller 10 may be performed without increasing the outer radial dimension of the flow channel 28 in order to increase the cross-sectional area of the flow channel 28. However, experimentally, it has been proven that increasing the outer radial dimension is more crucial than increasing the axial dimension. Regardless, in the design of housings for automotive HVAC systems, space constraints often cause the designer to make compromises in the design and such may be necessary In still other embodiments (not shown), increasing the cross-sectional area of the flow channel 28 may be performed by progressively decreasing the inner radial (i.e. horizontal) dimension of the flow channel 28 inward relative to the center axis O, that is, the inner wall of the housing 20 as it extends around the impeller 10.

It should be understood that the various structures for increasing the cross-sectional area of the flow channel 28 as it extends around the impeller 10 in order to decrease the velocity of the air exiting the impeller 10 and increase static pressure may be used alone or in combination with any of the other structures disclosed in this specification. It should also be understood that any reference to the "vertical", "horizontal", "upward", or "downward" directions are for the purposes of clarity with respect to the impeller housing and not the ultimate orientation of the impeller housing in a motor vehicle. The ultimate orientation of the impeller housing is not critical to the present invention.

Figure 6:
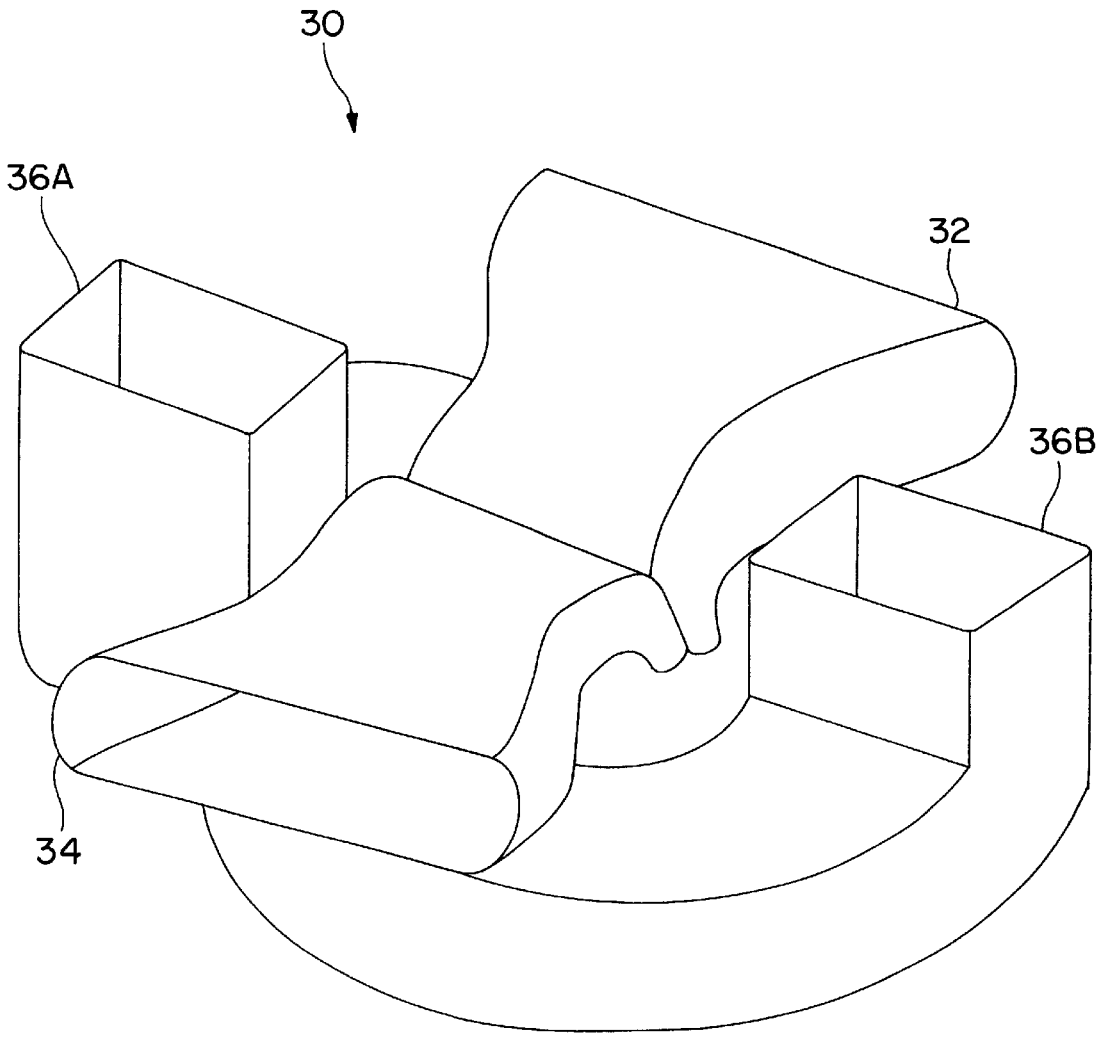
FIG. 6 is a perspective view of a first embodiment of a housing having two air outlets.
Figure 6A:
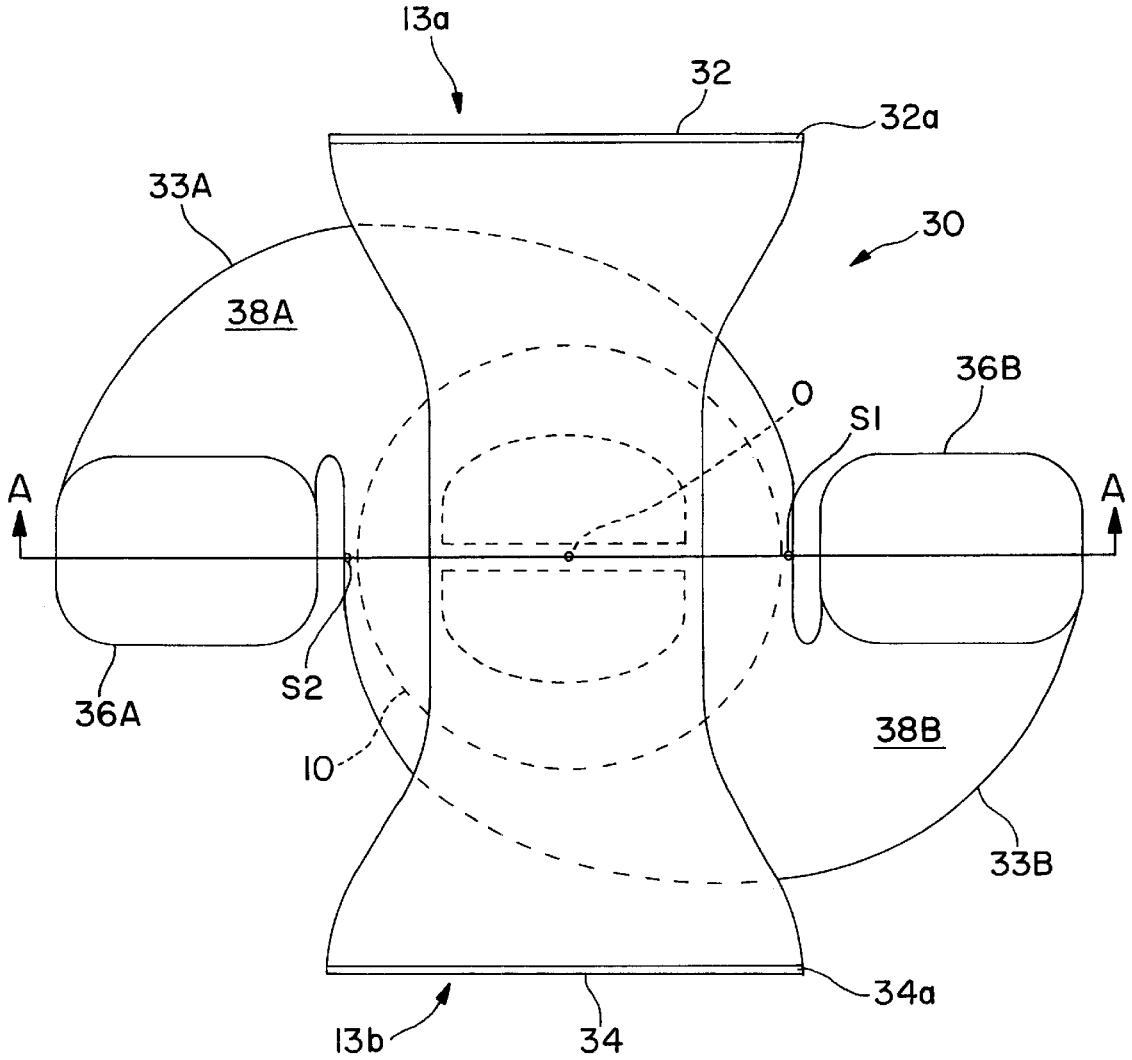
FIG. 6A is a top view of the impeller and housing of FIG. 6.

FIG. 6 shows a perspective of the impeller 10 in a housing 30 of another embodiment. Similar to housing 20, housing 30 has two air inlets 32 and 34. However, housing 30 may also have a single air inlet which receives air from a single source. As best shown in FIG. 6A, first air source 13*a* and second air source 13*b* pass through filters 32*a* and 34*a* respectively within air inlets 32 and 34 respectively. However, unlike housing 20, housing 30 has two air outlets 36A, 36B stemming from two flow channels 38A, 38B formed between the outside diameter OD of the impeller 10 and the outer walls 33A, 33B of the housing 30.

Similarly to that of the embodiment of FIG. 5A, in order to compress and densify the air exiting the impeller 10, that is, increase its static pressure; its velocity must be decreased. Once again, this is preferably accomplished by progressively increasing the cross-sectional area of the flow channels 38A, 38B as they proceed in their counterclockwise direction. Preferably, the cross-sectional area of the flow channels 38A, 38B increase by progressively increasing the outer radial (i.e. horizontal) dimension of the flow channels 38A, 38B outward relative to the center axis O, that is, the outer walls 33A, 33B of the housing 30 as they extend around the impeller 10. As shown in FIG. 6A, the flow channels 38A, 38B start with a narrow width at a points S1, S2 and progressively increase in width, and thus the cross-sectional area of the flow channels 38A, 38B as they spirals towards the air outlets 36A, 36B.

Figure 6B:
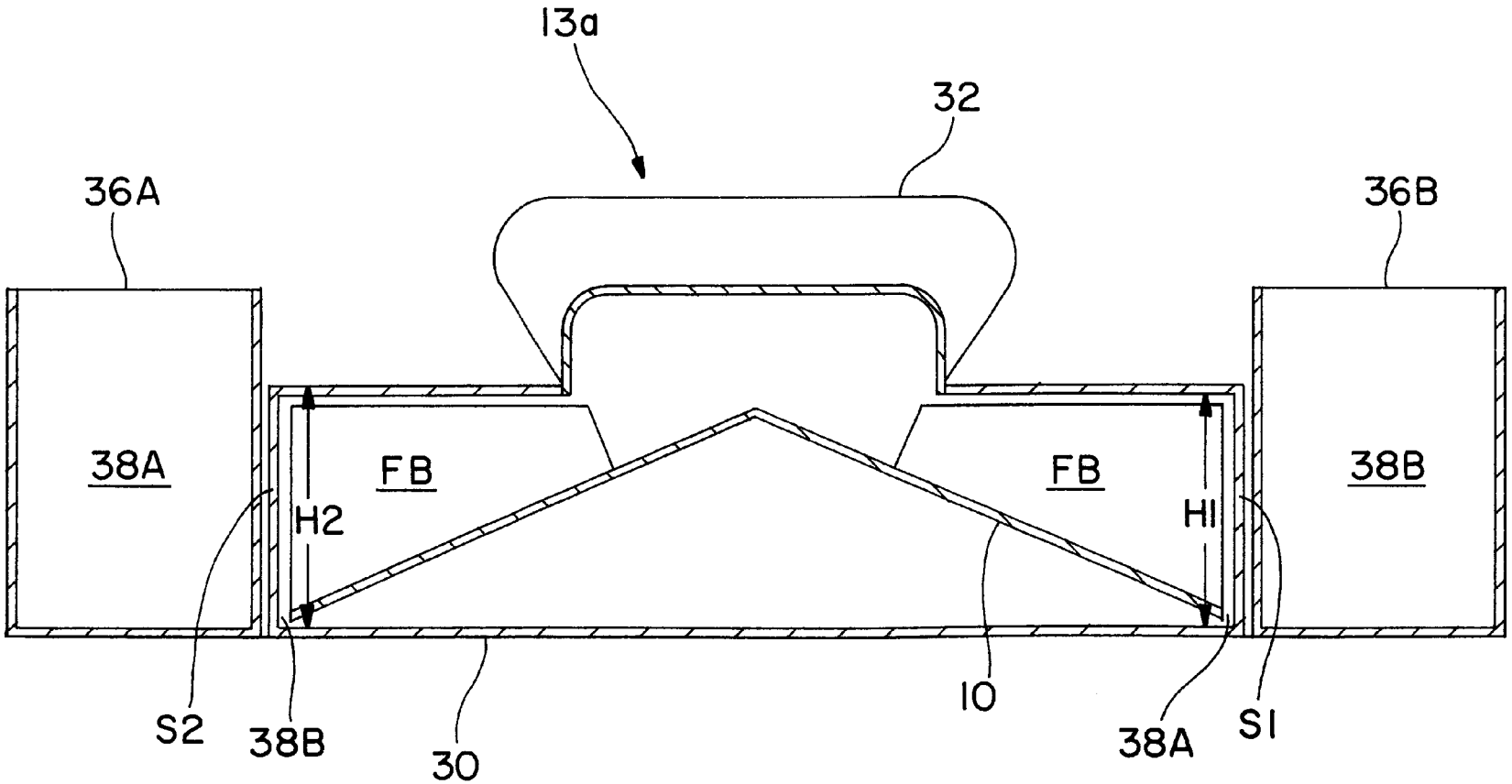
FIG. 6B is a section view of the impeller and housing of FIG. 6A along line A—A of FIG. 6A.
Figure 6C:
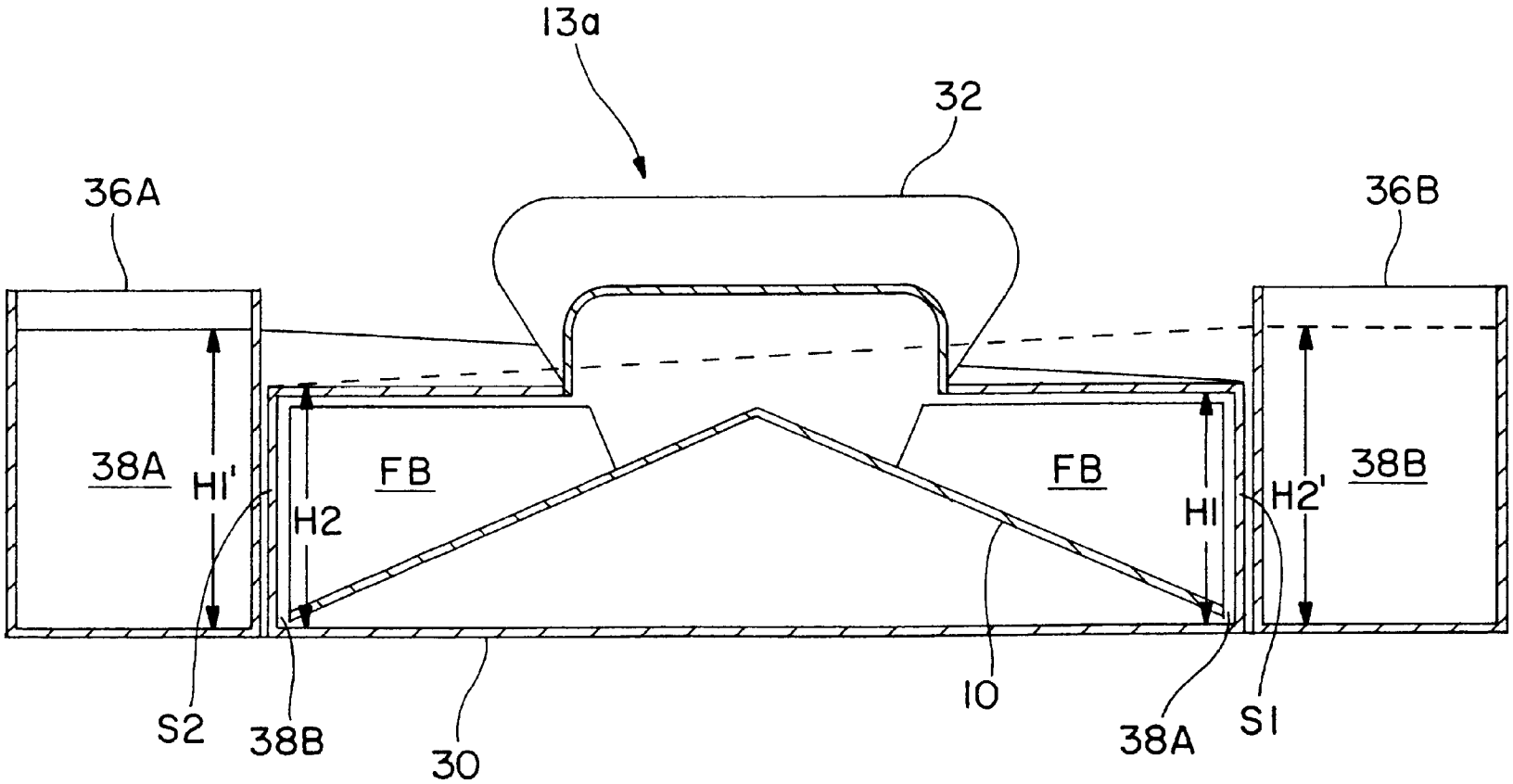
FIG. 6C is a section view of a second embodiment of a housing having two air outlets and taken along line A—A of FIG. 6A.

As shown in FIG. 6B, the axial (i.e. vertical) dimension of the flow channels 38A, 38B may remain at a constant height H1, H2 from the start points S1, S2 to the outlet 36A, 36B. However, in an alternative embodiment as shown in FIG. 6C, the heights H1, H2 of the flow channels 38A, 38B may progressively increase from heights H1, H2 at the start points S1, S2 to the heights H1', H2' at outlets 36A, 36B (Note: H2' and the associated change in height from H2 are depicted in phantom as they have been eliminated by the cross-section.

As previously discussed, automotive HVAC engineers are generally predisposed to extending a flow channel around the impeller substantially for its entire perimeter in order to reduce the rate of increasing the cross-sectional area of the flow channel as much as possible in efforts to gain static pressure. Consequently, the use of two flow channels 38A, 38B equal to roughly one-half the radial length of a single flow channel (i.e. 175 degrees vs. 350 degrees) is contrary to traditional design philosophy. However, the rate of increasing the cross-sectional area of the flow channel can be maintained by designing the sum of the cross-sectional areas of the two air outlets 38A, 38B to be equal to that of a single air outlet as used with a single flow channel. Even more preferably, the cross-sectional areas of each of the air outlets 38A, 38B should be equal, in which case the cross-sectional areas for each of the air outlets 38A, 38B will be one-half the cross-sectional area of a single air outlet as used with a single flow channel.

Air exiting the air outlets 38A, 38B preferably is preferably rejoined and in fluid communication with a plenum containing one or more dampers which control the flow of air to the evaporator and heater cores of the motor vehicle. However, it should be understood that the air exiting air outlets 38A, 38B may not be rejoined. For example, air exiting air outlet 38A may be in fluid communication with the evaporator while air exiting air outlet 38B may be in fluid communication with the heater core. For such a structure, a first damper may be located between air outlet 38A and the evaporator while a second damper is located between air outlet 38B and the heater core. In this manner, the air flow to the evaporator and the heater core may be regulated.

It should be understood that the preferred structure for increasing the cross-sectional area of the flow channels 38A, 38B as they extend around the impeller 10 in order to decrease the velocity of the air exiting the impeller 10 and increase static pressure (i.e. progressively increasing the outer radial (i.e. horizontal) dimension of the flow channels 38A, 38B outward relative to the center axis O) may be used alone or in combination with any of the other structures disclosed in this specification.

It should also be understood that the flow channels 38A, 38B are preferably symmetrical for simplicity purposes, may not be symmetrical (e.g. different shapes, different length, etc.). For example, the cross-sectional area of the flow channel 38A may increase by progressively increasing the outer radial (i.e. horizontal) dimension of the flow channel 38A outward relative to the center axis O, that is, the outer wall 33A of the housing 30 as it extends around the impeller 10. On the other hand, the cross-sectional area of the flow channel 38B may increase by progressively increasing the axial (i.e. vertical) dimension of the flow channel 38B relative to the center axis O as it extends around the impeller 10.

It should also be understood that the mass flow rate of air exiting the flow channels 38A, 38B at the air outlets 36A, 36B is preferably balanced (i.e. equal) as to balances the loads on the structure, but may not be balanced (i.e. unequal or unbalanced). Where the mass flow rate of air exiting the flow channels 38A, 38B at the air outlets 36A, 36B is preferably balanced, it is preferable that the flow channels 38A, 38B be symmetrical as the balancing of symmetrical flow channels is easier then the balancing of asymmetrical flow channels. However, it is recognized that the flow channels 38A, 38B may by asymmetrical, but yet provide the same mass flow rate.

It should also be understood that the two air outlets 36A, 36B are preferably equally circumferentially spaced 180 degrees around the center axis O of the impeller 10, but may not be equally circumferentially spaced around the center axis O of the impeller 10. Where the flow channels 38A, 38B are preferably symmetrical and the mass flow rate of air exiting the flow channels 38A, 38B at the air outlets 36A, 36B is preferably balanced, the two air outlets 36A, 36B are preferably equally circumferentially spaced 180 degrees around the center axis O of the impeller 10 to achieve this result. However, it is recognized that the two air outlets 36A, 36B may not be equally circumferentially spaced around the center axis.

It should also be understood that preferably the two flow channels 38A, 38B displace the air outlets 36A, 36B away from the impeller 10, but may not displace the air outlets 36A, 36B away from the impeller 10. In this manner the flow channels 38A, 38B are able to properly reduce the velocity of the air exiting the impeller 10 and increase its static pressure. If a flow channel does not displace an outlet away from the impeller (e.g. an air outlet in direct overlying relationship with the diameter of the impeller 10 such that air exiting the impeller blades can exit the housing before entering the flow channel) the amount of air entering the flow channel will decrease and the amount of static pressure created will be decreased accordingly.

An impeller housing 30 with two flow channels 36A, 36B and corresponding air outlets 38A, 38B offers a number of advantages over a housing with a single flow channel and a single outlet. An impeller housing with two flow channels and two corresponding air outlets which are symmetrical and have a balance mass flow rate is more structurally balanced than a housing with a single flow channel and a single outlet. Consequently, the two channel/outlet housing offers better air flow symmetry, reduced noise, vibration and harshness (NVH), reduced need for isolation structure. Further, when the radial length of a flow channel is decreased to roughly one-half its conventional length (i.e. 175 degrees vs. 350 degrees) aerodynamic losses (associated with boundary layer effects) and diffusion times decrease. Consequently, there is higher efficiency and better energy management.

It should also be understood that it is within the contemplation of the impeller housing of the present invention to have more than two flow channels and two air outlets. For example, a housing may have three flow channels and three corresponding air outlets. Preferably, the three air outlets would be equally circumferentially spaced 120 degrees around the center axis O of the impeller and the mass flow rate of air through the flow channels would be balanced.

It should also be understood that it is within the contemplation of the impeller housing of the present invention that the number of air outlets equal the number of flow channels. However, it may be possible that an air outlet is in fluid communication with more than one flow channel or that one flow channel may be subdivided into more than one air outlet.

Those skilled in the art will appreciate that still other modifications and variations of the present invention are possible in light of the above teachings. It is, therefore, to be understood that within the scope of the appended claims, the invention may be practiced otherwise than literally described, but fall within the scope therein.

I claim:

1. A centrifugal impeller, comprising:

a plurality of impeller blades radially spaced about a center axis, each impeller blade comprising a leading edge, a trailing edge, a front surface and a rear surface, an upper edge and a lower edge;

at least one portion of the front surface or the rear surface of said impeller blade, between said leading edge and trailing edge and between said upper and lower edge, comprising an arc of constant radius extending from the impeller blade leading edge to the impeller blade trailing edge, and adjacent impeller blades radially spaced by a separation angle; the impeller blade leading edge is radially spaced from the impeller blade trailing edge by three times the separation angle.

2. The centrifugal impeller of claim 1 wherein:

the impeller blade further comprises an outside diameter radius spaced about said center axis; and the radius of said arc extending from the impeller blade leading edge to the impeller blade trailing edge is in the range between and including ½ to ⅔ of the impeller blade outside diameter radius.

3. The centrifugal impeller of claim 1 wherein:

the impeller blade further comprises an inside diameter radius spaced about said center axis and an outside diameter radius spaced about said center axis; and the impeller blade inside diameter radius is in the range between and including ¼ to ½ of the impeller blade outside diameter radius.

4. The centrifugal impeller of claim 1 wherein:

the impeller blade further comprises an inside diameter radius spaced about said center axis and an outside diameter radius spaced about said center axis; and the impeller blade inside diameter radius is equal to ⅓ of the impeller blade outside diameter radius.

5. The centrifugal impeller of claim 1 wherein the plurality of impeller blades comprises a prime number.

6. The centrifugal impeller of claim 1 wherein the impeller has a height as between said upper edge and lower edge at the trailing edge, and an arc extending from said leading edge and said trailing edge, such that the ratio of said height to the radius of said arc is between 0.5–3.5.

* * * * *